US009062484B2

(12) United States Patent
Miller

(10) Patent No.: US 9,062,484 B2
(45) Date of Patent: Jun. 23, 2015

(54) ACCORDION SHUTTER HINGE ASSEMBLY

(71) Applicant: Qualitas Manufacturing, Inc., Itasca, IL (US)

(72) Inventor: James V. Miller, Glen Ellyn, IL (US)

(73) Assignee: Qualitas Manufacturing, Inc., Itasca, IL (US)

( * ) Notice: Subject to any disclaimer, the term of this patent is extended or adjusted under 35 U.S.C. 154(b) by 88 days.

(21) Appl. No.: 13/918,463

(22) Filed: Jun. 14, 2013

(65) Prior Publication Data

US 2014/0367056 A1 Dec. 18, 2014

(51) Int. Cl.

| | |
|---|---|
| ***E06B 3/48*** | (2006.01) |
| ***E05D 1/04*** | (2006.01) |
| ***E05D 3/12*** | (2006.01) |
| ***E05D 15/12*** | (2006.01) |

(52) U.S. Cl.

CPC . *E05D 1/04* (2013.01); *Y10T 16/52* (2013.01); *E06B 3/481* (2013.01); *E05D 3/12* (2013.01); *E05D 15/12* (2013.01); *E05Y 2800/41* (2013.01)

(58) Field of Classification Search

USPC ..... 160/183, 199, 206, 229.1, 235; 16/365, 16/366, 269

IPC ..... E06B 3/481

See application file for complete search history.

(56) References Cited

U.S. PATENT DOCUMENTS

| | | | | |
|---|---|---|---|---|
| 3,205,935 | A * | 9/1965 | Cayton | 160/183 |
| 3,359,594 | A * | 12/1967 | Johannes | 16/356 |
| 3,720,255 | A * | 3/1973 | Ueda | 160/199 |
| RE29,308 | E | 7/1977 | Dagenais | |
| 4,276,919 | A * | 7/1981 | Walters | 160/206 |
| 4,386,645 | A | 6/1983 | Dever et al. | |
| 4,387,760 | A * | 6/1983 | Greschbach | 160/229.1 |
| 4,434,525 | A * | 3/1984 | Labelle | 16/355 |
| 4,660,613 | A * | 4/1987 | Dagenais | 160/199 |
| 4,848,436 | A | 7/1989 | Dagenais | |
| 5,099,904 | A * | 3/1992 | Susnar | 160/199 |

(Continued)

FOREIGN PATENT DOCUMENTS

| | | |
|---|---|---|
| EP | 0031970 A1 | 7/1981 |
| EP | 1298270 B1 | 7/2008 |
| WO | WO 91-12402 A1 | 8/1991 |

OTHER PUBLICATIONS

International Search Report and Written Opinion issued in related PCT Application No. PCT/US2014/042334; report dated Jun. 13, 2014, 18 pages.

*Primary Examiner* — David Purol

(74) *Attorney, Agent, or Firm* — Miller, Matthias & Hull LLP

(57) ABSTRACT

A hinge assembly connecting adjacent panels of an accordion shutter includes a hinge member having a pair of curved arms and a pair of panel connection members each having a pivot shaft. The pivot shafts are received within the corresponding curved arms and retained for rotation therein with the tips of the curved arms received in arm receiving channels of the panel connection members. The adjacent panels may be oriented at an angle of less than 180° with respect to each other when both panel connection members are rotated to positions wherein the tips of curved arms are engaged by the closed ends of the arm receiving channels. The base of the hinge member also has a pair of shoulders, and the adjacent panels are oriented approximately parallel when the panel connection members are rotated to positions wherein the panel connection members are engaged by the shoulders.

20 Claims, 5 Drawing Sheets

(56) References Cited

U.S. PATENT DOCUMENTS

| | | | | | |
|---|---|---|---|---|---|
| 5,150,501 | A | | 9/1992 | Pasternak | |
| 5,199,478 | A | * | 4/1993 | Kubota | 160/40 |
| 5,220,951 | A | | 6/1993 | Dagenais | |
| 5,448,799 | A | * | 9/1995 | Stein, Jr. | 16/225 |
| 5,472,037 | A | | 12/1995 | Hoffman | |
| 5,549,148 | A | | 8/1996 | Figueiredo et al. | |
| 5,601,130 | A | | 2/1997 | Werner et al. | |
| 5,682,643 | A | * | 11/1997 | Duffy | 16/265 |
| 5,740,850 | A | | 4/1998 | Hoffman | |
| 5,782,282 | A | * | 7/1998 | Chen | 160/206 |
| 5,918,659 | A | * | 7/1999 | Lee | 160/199 |
| 6,021,839 | A | | 2/2000 | Knezevich et al. | |
| 6,122,868 | A | | 9/2000 | Knezevich | |
| 6,546,681 | B1 | | 4/2003 | Trundle | |
| 7,874,341 | B2 | | 1/2011 | Coleman et al. | |
| 8,191,603 | B1 | | 6/2012 | Motosko | |

* cited by examiner

ACCORDION SHUTTER HINGE ASSEMBLY

TECHNICAL FIELD

This disclosure relates generally to foldable closures such as accordion-type folding shutters and, more particularly, to an improved hinge assembly for connecting vertical panels of the accordion shutter and allowing relative rotation between the vertical panels without creating pinch points that can catch the fingers of individuals manipulating the accordion shutter.

BACKGROUND

Accordion shutters are used in a variety of applications where closure of an area is desired. For example, accordion shutters may be used to enclose the area in front of a door or window, to secure the entryway of a store in a mall, and to cover the open customer service area or window of a kiosk. The benefits of using an accordion shutter are well known. The accordion shutters can be installed and extend over long, irregularly shaped horizontal runs, and then easily stored in a relatively small storage closet at one or both ends of the opening when the shutter is retracted, folded and collapsed. There are many design options for accordion shutters. The accordion shutters can have curtains formed from solid opaque panels, or panels having openings or fabricated from translucent polycarbonate materials to allow a measure of visibility there through in addition to providing security.

The adjacent panels of the accordion shutters are connected along their lateral edges by vertical hinge assemblies allowing relative rotational movement between the panels. One such hinge assembly is disclosed in U.S. Pat. No. 5,740,850 issued to Hoffman on Apr. 21, 1998. In the Hoffman patent, each elongated vertical panel of the accordion shutter has an inner tube-like connection member along one lateral edge of the panel body portion, and an outer tube-like connection member along the opposite lateral edge. The inner connection member of one panel is inserted into the outer connection member of the adjacent panel to form the hinge with the inner connection member being able to pivot within the outer connection member. With this configuration, pinch points exist on both sides of the hinge where beads of the outer connection member engage a bent edge strip connecting the panel body portion to the inner connection member to limit the relative rotation of the hinge components and the corresponding panels. Sufficient space exists between the beads and the bent edge strip to permit an individual's finger to be caught there between and pinched.

Another example of a hinge assembly in an accordion shutter is disclosed in U.S. Pat. No. 5,150,501 issued to Pasternak on Sep. 29, 1992. The accordion shutter of the Pasternak patent is comprised of a plurality of elongated vertical panels interconnected along their vertical edges by hinge assemblies to permit the panels to fold in an accordion fashion for storage and to extend in an undulating stretched manner to obstruct an opening. The hinge assembly has a plurality of hinge attaching members with outwardly extending connecting ribs stacked and connected for rotation by a hinge rod, and a pair of opposed panel connecting posts that are detachably securable to the connecting ribs of the hinge attaching members. The stack of hinge attaching members alternate between the panel connection posts so that each hinge attaching member pivots relative to the two adjacent hinge attaching members as the hinge assembly opens and closes. The connecting posts further have a connecting slot for securing panel elements thereto. As the connecting posts rotate about the hinge rod toward the open position of the panel elements when the accordion shutter is extended, abutment faces of the connecting posts come into contact to limit the rotation of the hinge assembly, and thereby provide a pinch point on one side of the hinge assembly. In addition to creating a pinch point, assembly of the Pasternak design is relatively difficult and the design creates multiple wear surfaces between the various components.

In view of this, a need exists for an improved accordion shutter hinge assembly that substantially eliminates pinch point risks for individuals manipulating the accordion shutter and requires minimal components and assembly complexity during installation.

SUMMARY OF THE DISCLOSURE

In one aspect of the present disclosure, a hinge assembly for connecting adjacent panels of a foldable closure along lateral edges of the adjacent panels is disclosed. The hinge assembly may include a hinge member having a pair of curved arms each having a tip and a substantially constant radius of curvature to sweep semi-circular arcs about a corresponding longitudinal axis of the curved arm, and a pair of panel connection members each having a pivot shaft, a panel connection portion configured to engage and retain a lateral edge of one of the adjacent panels, and a curved connection portion connecting the panel connection portion to the pivot shaft. An inner surface of the curved connection portion and a portion of an outer surface of the pivot shaft of each panel connection member define an arm receiving channel may have a closed end. The pivot shaft of each of the pair of panel connection members may be disposed within a corresponding one of the pair of curved arms of the hinge member and retained for rotation therein and with the tip of the curved arm received in the arm receiving channel of the panel connection member. The adjacent panels connected by the hinge assembly may be oriented at an angle of less than 180° with respect to each other when both panel connection members are rotated to positions wherein the tips of the pair of curved arms are engaged by the closed ends of the arm receiving channels of the panel connection members.

In another aspect of the present disclosure, a foldable closure is disclosed. The foldable closure may include a pair of adjacent panels each having a lateral edge, a hinge member having a pair of curved arms each having a tip and a substantially constant radius of curvature to sweep semi-circular arcs of greater than 180° about a corresponding longitudinal axis of the curved arm, and a pair of panel connection members each having a pivot shaft, a panel connection portion engaging and retaining the lateral edge of one of the pair of adjacent panels, and a curved connection portion connecting the panel connection portion to the pivot shaft. An inner surface of the curved connection portion and a portion of an outer surface of the pivot shaft of each panel connection member may define an arm receiving channel having a closed end. The pivot shaft of each of the pair of panel connection members may be disposed within a corresponding one of the pair of curved arms of the hinge member and retained for rotation therein, with the tip of the curved arm received in the arm receiving channel of the panel connection member. The pair of adjacent panels may be oriented at an angle of less than 180° with respect to each other when both panel connection members are rotated to positions wherein the tips of the pair of curved arms may be engaged by the closed ends of the arm receiving channels of the panel connection members.

In a further aspect of the present disclosure, a hinge assembly for connecting adjacent panels of a foldable closure along lateral edges of the adjacent panels is disclosed. The hinge assembly may include a hinge member having a base, a pair of curved arms extend outwardly in opposite directions from the base, with each curved arm having a tip and a substantially constant radius of curvature to sweep semi-circular arcs about a corresponding longitudinal axis of the curved arm, and a finger protection bar extending from the base between the pair of curved arms, wherein the tip of each of the pair of curved arms and the finger protection bar define a gap there between. The hinge assembly may also include a pair of panel connection members, with each panel connection member including a pivot shaft, a panel connection portion configured to engage and retain a lateral edge of one of the adjacent panels, and a curved connection portion connecting the panel connection portion to the pivot shaft, wherein an inner surface of the curved connection portion and a portion of an outer surface of the pivot shaft of each of the pair of panel connection members define an arm receiving channel having a closed end. The pivot shaft of each of the pair of panel connection members may be disposed within a corresponding one of the pair of curved arms of the hinge member and retained for rotation therein with the curved connection portion disposed within the gap defined by the finger protection bar and the tip of the curved arm retaining the pivot shaft, and with the tip of the curved arm received in the arm receiving channel of the panel connection member. The adjacent panels connected by the hinge assembly may be oriented at an angle of less than 180° with respect to each other when both panel connection members are rotated to positions wherein the tips of the pair of curved arms are engaged by the closed ends of the arm receiving channels of the panel connection members.

Additional aspects are defined by the claims of this patent.

DETAILED DESCRIPTION

Although the following text sets forth a detailed description of numerous different embodiments of the present disclosure, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

It should also be understood that, unless a term is expressly defined in this patent using the sentence "As used herein, the term '_____' is hereby defined to mean . . ." or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112(f).

Figure 1:
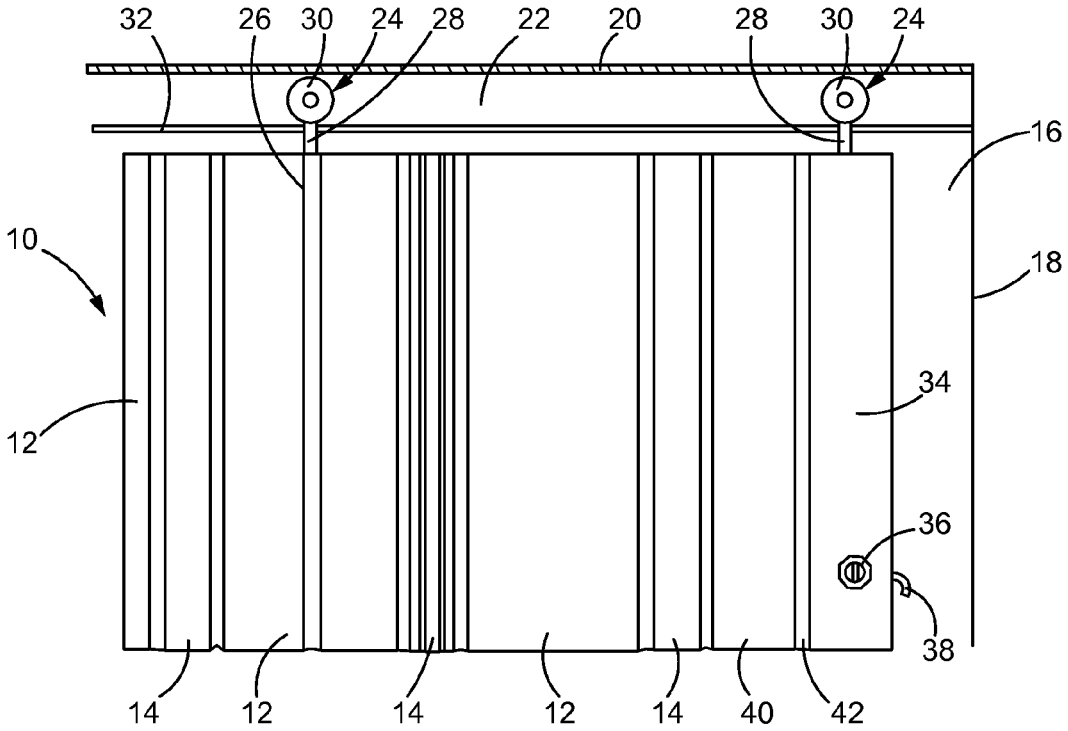
FIG. 1 is a fragmented front view of a portion of an accordion shutter installed in an opening to secure the opening.
Figure 2:
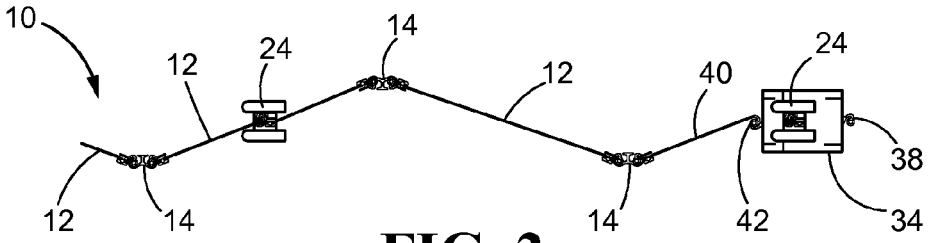
FIG. 2 is a plan view of the accordion shutter of FIG. 1 in an extended position.
Figure 3:
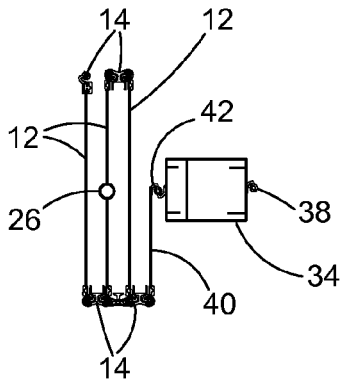
FIG. 3 is a plan view of the accordion shutter of FIG. 1 in a retracted folded position.

FIGS. 1-3 illustrate a foldable closure in the form of an accordion-type folding shutter 10 that is formed by a plurality of substantially flat, elongated vertical panels 12. The lateral edges of adjacent panels 12 are pivotally connected together by hinge assemblies 14 that are described in detail below. The arrangement of the panels 12 and the hinge assemblies 14 is conventional with the exception of the specific design of the hinge assemblies 14 and, therefore, the accordion shutter 10 is schematically described. The panels 12 typically are formed of extruded metal, such as aluminum, extruded plastic, or other appropriate material such as polycarbonate materials, to provide desired levels of strength and visibility. The interconnected panels 12 form the accordion shutter 10 that is installed to cover, when the accordion shutter 10 is extended or unfolded, an opening 16 in a building wall 18. The opening 16 may be a window, a door, or an open doorway or the like, formed in the wall 18 of a building or other structure.

Referring to FIG. 1, the accordion shutter 10 is mounted from an upper track or guide rail 20 that, for example, may be formed of extruded aluminum material. The guide rail 20 forms an inverted open channel 22 that is secured to the structure at the top of the opening 16 by screws or other suitable fasteners (not shown). The accordion shutter 10 is suspended from the guide rail 20 by a plurality of guide roller assemblies 24. Some or all of the panels 12 may be provided with screw bosses 26 configured to receive support rods 28 of the guide roller assemblies 24. Guide rollers 30 are mounted on the support rods 28 and are engaged by inwardly extending lips 32 of the guide rail 20 to allow the accordion shutter 10 to be extended and retracted over the opening 16.

A right-hand free end of the accordion shutter may include an end panel 34 that may contain a suitable lock 36 to regulate the latch 38 cooperating with an appropriate latch receiver (not shown) associated with the side wall 18. The end panel 34 may be suspended from the guide rail 20 by a guide roller assembly 24, and may be connected to a half panel 40 by a half hinge 42. As shown in FIG. 2, when the accordion shutter 10 is extended, the hinge assemblies 14 open close to 180° to minimize the amount of shutter curtain required to cover the opening 16. The hinge assemblies 14 do not, however, open to 180° or invert so that the accordion shutter 10 will easily fold up when the end panel 34 is pushed to the left to the closed or stowed position shown in FIG. 3 with the hinge assemblies 14 closing so that the panels 12 are approximately parallel.

Figure 4:
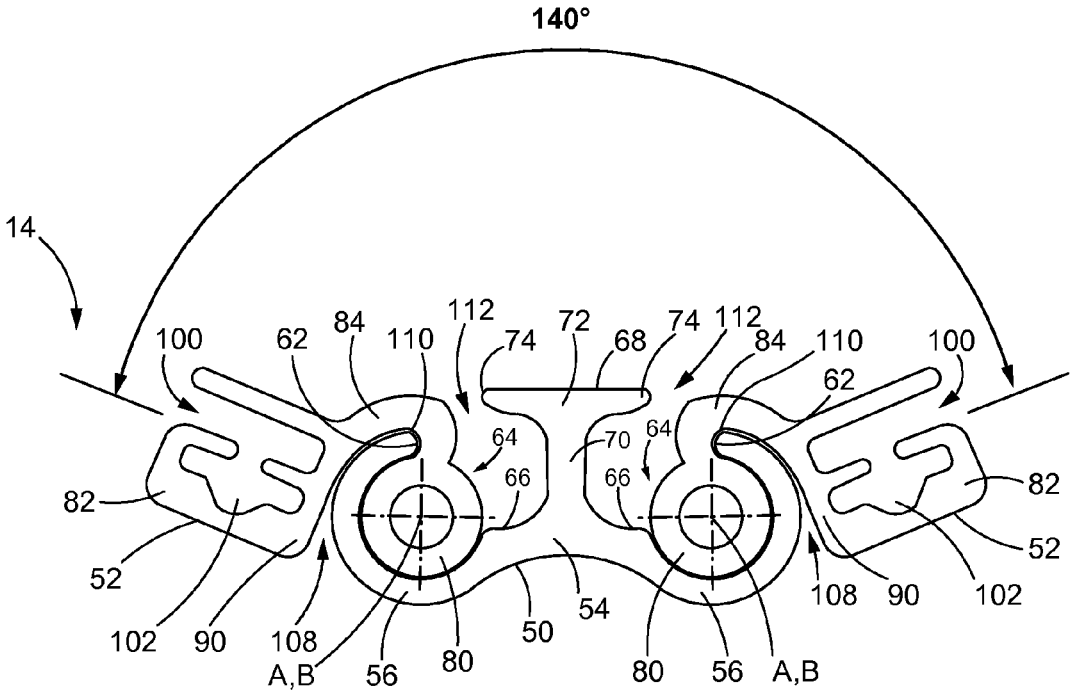
FIG. 4 is a plan view of an embodiment of a hinge assembly of the accordion shutter of FIG. 1 in an open position.

The structure of the hinge assembly 14 is shown in greater detail in FIGS. 4-7. Referring to FIG. 4, the hinge assembly 14 includes a hinge member 50 and a pair of panel connection members 52 pivotally mounted thereto. Each of the panel connection members 52 is in turn connected to a corresponding vertical lateral edge of one of the adjacent panels 12 as will be described more fully. As shown in greater detail in FIG. 5, the hinge member 50 includes a base 54 and a pair of oppositely disposed outwardly extending curved arms 56. The curved arms 56 have a substantially constant thickness and a substantially constant radius of curvature to sweep semi-circular arcs about corresponding longitudinal axes A. As a result, each of the curved arms 56 has a concave inner surface 58 with a substantially constant inner diameter and a convex outer surface 60 with a substantially constant outer diameter. Each of the curved arms 56 terminates at a tip 62, thereby creating a first gap 64 between the tip 62 and a corresponding shoulder 66 of the base 54 that will allow the corresponding panel connection member 52 to rotate relative to the hinge member 50 between open and closed positions while being retained therein by the curved arms 56.

In the illustrated embodiment, the hinge member 50 further includes a T-shaped finger protection bar 68 extending outwardly from the base 54 between the tips 62 of the curved arms 56. The finger protection bar 68 includes an extension portion 70 extending from the base 54 and a cross member 72 oriented transversely to the extension portion 70 and having oppositely disposed ends 74. Each end 74 of the cross member 72 combines with the tip 62 of the corresponding curved arm 56 to define a second gap 76 there between for receiving a portion of the corresponding panel connection member 52 as described more fully below.

Figure 6:
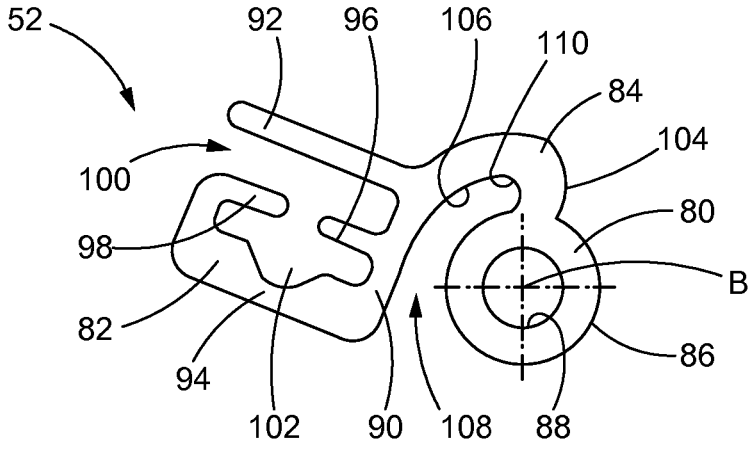
FIG. 6 is a plan view of a panel connection member of the hinge assembly of FIG. 4.

The panel connection member 52 is illustrated in further detail in FIG. 6. The panel connection member 52 includes a pivot shaft in the form of a hollow cylindrical tube 80, a panel connection portion 82, and a curved connection portion 84 connecting the cylindrical tube 80 to the panel connection portion 82. The cylindrical tube 80 has a longitudinal axis B and a cylindrical outer surface 86 having a substantially constant outer diameter that is smaller than the inner diameter of the inner surfaces 58 of the curved arms 56 of the hinge member 50 so that the cylindrical tube 80 may be received by one of the curved arms 56 and rotate therein. The cylindrical tube 80 may also include an inner surface 88 having an inner diameter and defining a throughbore extending the length of the cylindrical tube 80. The material removed or omitted from the cylindrical tube 80 during extrusion or other fabrication process may reduce the weight and cost of the hinge assembly 14 and provide for attachment of suitable alignment members (not shown) known in the art that may engage the ends of the hinge member 50 and panel connection member 52 to substantially prevent relative axial movement of the members 50, 52 relative to each other. Alternatively, the cylindrical tube 80 may be replaced by a pivot shaft in the form of a solid rod having the same outer diameter or of an arcuate segment forming a partial tube having an opening through the side as will be illustrated and described below in alternative embodiments.

The panel connection portion 82 is configured to receive corresponding lateral edges of the panels 12 connected by the hinge assembly 14. The panel connection portion 82 includes an end wall 90, an outwardly extending first flange 92 and an outwardly extending second flange 94 forming a generally U-shaped channel extending the length of the panel connection portion 82. The panel connection portion 82 further includes a first rib 96 extending outwardly between the flanges 92, 94, and a second rib 98 extending inwardly from an end of the second flange 94 toward the first flange 92 and then further extend parallel to the first flange 92 toward the first rib 96. The first flange 92 and the ribs 96, 98 define a panel receiving channel 100 for receiving the lateral edge of the panel 12 therein. The second flange 94, the ribs 96, 98 and a corresponding portion of the end wall 90 define a receiving opening 102 that may receive and engage a locking portion of the edge of the panel 12 to secure the panel 12 to the panel connection portion 82 as discussed further below.

The curved connection portion 84 connects the cylindrical tube 80 to the panel connection portion 82 and includes a convex outer surface 104 and a concave inner surface 106. The outer surface 104 is shaped to allow the cylindrical tube 80 to rotate within the curved arm 56 of the hinge member 50 as will be discussed further below. The inner surface 106 of the connection portion 84 defines an arc having an approximately constant radius and is approximately parallel to a corresponding portion of the outer surface 86 of the cylindrical tube 80 to define an arm receiving channel 108 having a substantially constant width and terminating at a closed end 110. The channel 108 is configured to receive a corresponding curved arm 56 of the hinge member 50 and allow movement of the curved arm 56 therein for rotation of the panel connection member 52.

Returning to FIG. 4, the hinge assembly 14 is shown as assembled with the panel connection members 52 rotated to an open position that may be achieved when the accordion shutter 10 is extended to cover the opening 16 as shown in FIG. 2. In the current embodiment, the hinge assembly 14 is configured to open so that the associated panels 12 are oriented at an angle of approximately 140° with respect to each other. The components are assembled by inserting the cylindrical tubes 80 of each panel connection member 52 into a corresponding one of the curved arms 56 with the connection portion 84 extending through the first gap 64 and the second gap 76. The inner surfaces 58 of the curved arms 56 extend from the corresponding tips 62 to the shoulders 66 through arcs that are greater than 180° to retain the cylindrical tubes 80 therein. The curved arms 56 are received in the channels 108 defined by the outer surfaces 86 of the cylindrical tubes 80 and the inner surfaces 106 of the connection portions 84. In this way, the combinations of the cylindrical tubes 80 and the connection portions 84 provide internal and external support for the curved arms 56. The panel connection members 52 may rotate toward the open position until the tips 62 engage the closed ends 110 of the channels 108 to limit the rotation of the panel connection members 52 at the desired position. Small gaps 112 exist between the ends 74 of the finger protection bar 68 and the outer surface 104 of the connection portions 84, but have sufficiently small widths that the fingers of the installers or others manipulating the accordion shutter 10 are substantially restricted from being inserted therein and pinched when the panel connection members 52 rotate toward their closed positions.

Figure 7:
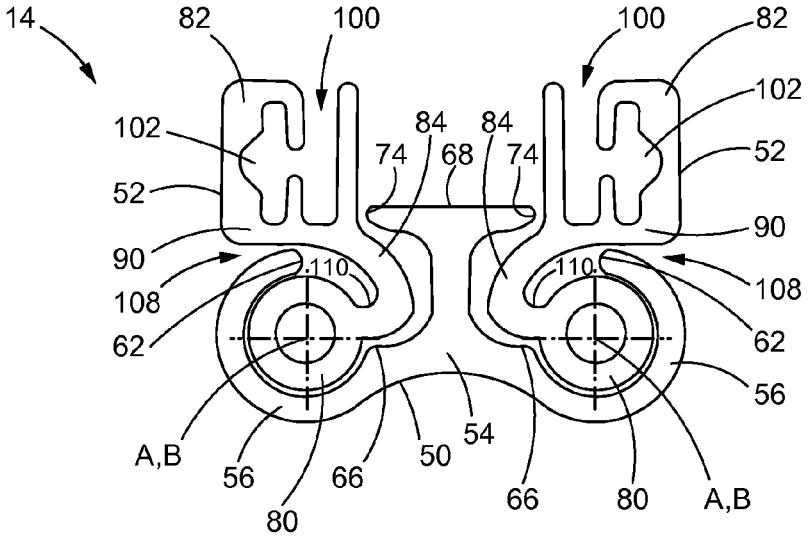
FIG. 7 is a plan view of the hinge assembly of FIG. 4 in a closed position.
Figure 5:
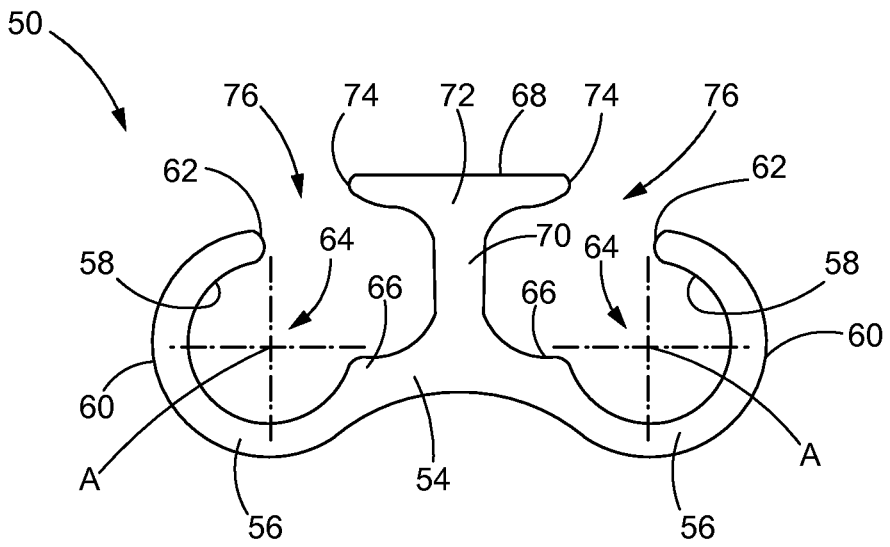
FIG. 5 is a plan view of a hinge member of the hinge assembly of FIG. 4.

FIG. 7 illustrates the hinge assembly 14 with the panel connection members 52 rotated to their closed positions when the accordion shutter 10 is retracted to the position shown in FIG. 3 for storage. In this position, the panels 12 may be approximately parallel to each other so that minimal space is required for storage. As the panel connection members 52 rotate inwardly, the closed ends 110 of the channels 108 rotate away from the tips 62 of the curved arms 56 and the connection portions 84 rotate toward the shoulders 66 of the base 54 of the hinge member 50. Depending on the particular configuration of the hinge assembly 14, the panel connection members 52 rotate inwardly until the connection portions 84 are engaged by the corresponding shoulders 66 or the end walls 90 or first flanges 92 are engaged by the corresponding ends 74 of the finger protection bar 68. As will be apparent, each panel connection member 52 is capable of rotating through approximately 70° of rotation. Small spaces exist between the curved arms 56 and corresponding end walls 90 of the panel connection portions 82. However, as with the gaps 112, the small spaces substantially prevent fingers from being inserted therein to avoid pinching.

Figure 8:
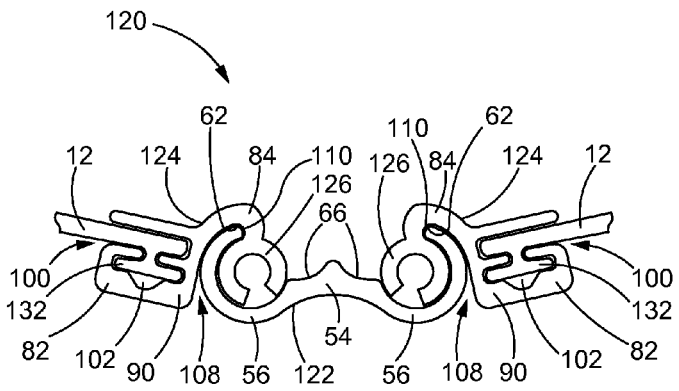
FIG. 8 is a plan view of an alternative embodiment of a hinge assembly of the accordion shutter of FIG. 1 in an open position.
Figure 9:
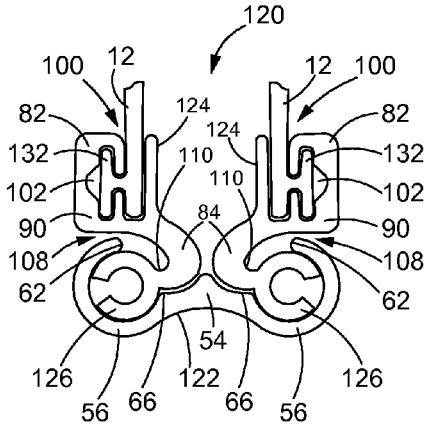
FIG. 9 is a plan view of the hinge assembly of FIG. 8 in a closed position.

FIGS. 8 and 9 illustrate an alternative embodiment of a hinge assembly 120 in accordance with the present disclosure. In this embodiment, elements of the hinge assembly 120 that are similar to elements of the hinge assembly 14 as described above are identified with the same reference numerals. A hinge member 122 has a base 54 and curved arms 56 that are similar to the base 54 and curved arms 56 of the hinge member 50, but the finger protection bar 68 is omitted. Panel connection members 124 are similar to the panel connection members 52, with the cylindrical tubes 80 being replaced by elongated penannular pivot shafts 126 having openings 128 opposite points of attachment with the connection portions 84. The panel connection portion 82 has a similar configuration as described above. The panel lock receiving openings 102 are shown receiving and retaining lateral edges 130 of panels 12. Proximate the lateral edges 130, the panels 12 include elongated lock members 132 attached thereto and being configured to insert into the receiving openings 102 when the panels 12 are installed.

As shown in FIG. 8, the panel connection members 124 rotate to the open positions until the closed ends 110 are engaged by the tips 62 of the curved arms 56. The panels 12 may rotate to an orientation that approaches 180° with respect to each other, and may be greater than 140°, but is less than 180° to prevent the panels 12 and hinge assembly 120 from inverting and creating difficulty in collapsing the accordion shutter 10. When the hinge assembly 120 collapses to the closed position shown in FIG. 9, the panel connection members 124 rotate toward each other until the curved connection portions 84 are engaged by the shoulders 66 of the hinge member 122 and the panels 12 are aligned parallel to each other. At all points in the range of rotation of the panel connection members 124, the openings 128 of the pivot shafts are within the arc defined by the inner surfaces 58 of the curved arms 56 so that the curved arms 56 retain the pivot shafts 126 therein. In this embodiment, pinch points on the exterior of the hinge assembly 120 are substantially eliminated. A potential pinch point may exist on the interior of the hinge assembly 120 due to the absence of the finger protection bar 68, but the incidence of engagement of an installer or deployer of the accordion shutter 10 with the interior of the hinge assembly 120 is much less frequent than the exterior of the hinge assembly 120. However, the hinge assembly 120 has a spread design wherein the panel connection portions 82 are spaced from each other when the hinge assembly 120 is in the collapsed position shown in FIG. 9 to minimize the pinch risk on the interior of the hinge assembly 120.

Figure 10:
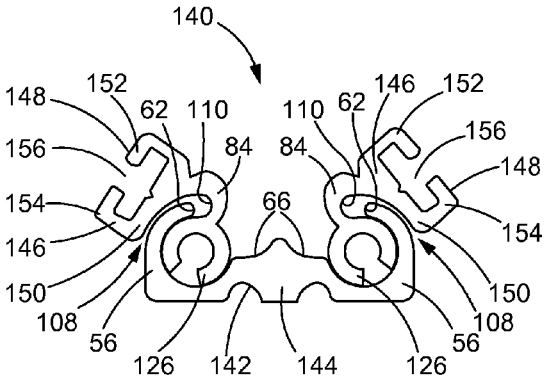
FIG. 10 is a plan view of a further alternative embodiment of a hinge assembly of the accordion shutter of FIG. 1 in an open position.
Figure 11:
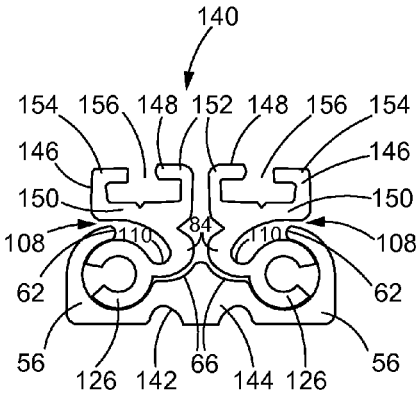
FIG. 11 is a plan view of the hinge assembly of FIG. 10 in a closed position

FIGS. 10 and 11 illustrate a further alternative embodiment of a hinge assembly 140 in accordance with the present disclosure. A hinge member 142 includes a base 144 with curved arms 56 extending from shoulders 66. Panel connection members 146 may be similar to the panel connection members 52, 124, and each includes an elongated penannular pivot shaft 126 and a panel connection portion 148 connected to the pivot shaft 126 by a curved connection portion 84. The panel connection portion 148 is configured to function with an alternate configuration of the panels 12 wherein the lateral edges of the panels 12 have flanges extending outwardly perpendicular to the planes of the panels 12. To accommodate such panels 12, the panel connection portion 148 includes an end wall 150 at an end of the curved connection portion 84, and a first flange 152 and a second flange 154 that extend outwardly from corresponding ends of the end wall 150 and then inwardly to form a panel lateral edge receiving opening 156 and engage the flanges of the panels 12 to retain the edges of the panels 12 therein. With this configuration, the hinge assembly 140 can move between a fully extended position with the closed ends 110 of the panel connection members 146 engaging the tips 62 of the curved arms 56 and a closed or collapsed position as shown in FIG. 11 with the curved connection portions 84 engaged by the shoulders 66 of the hinge member 142.

Figure 12:
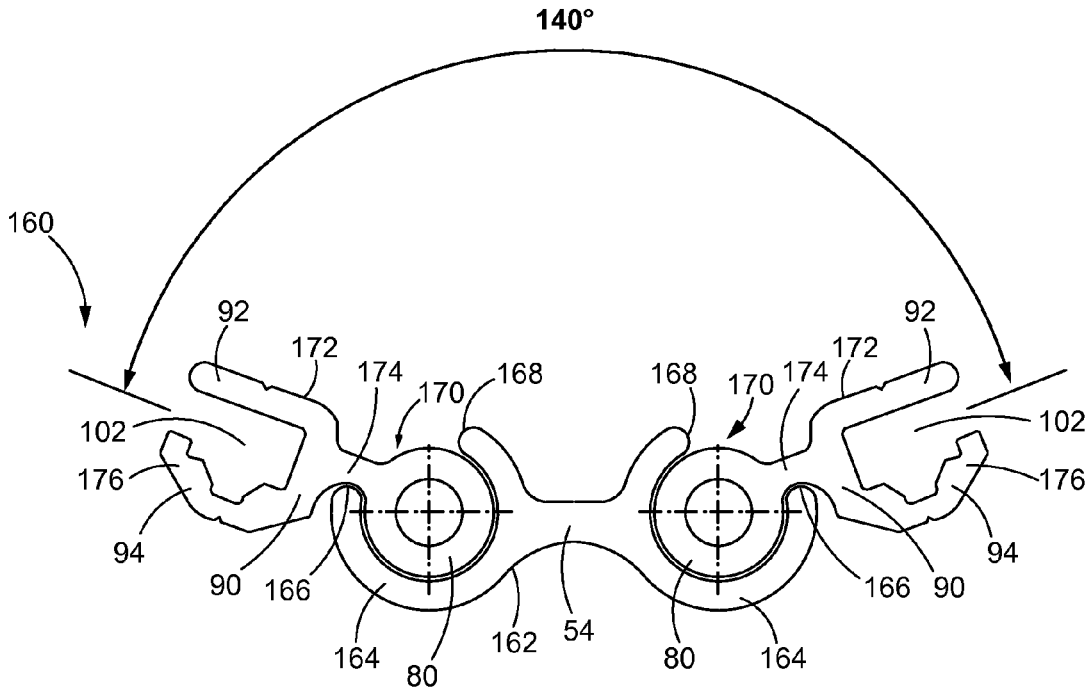
FIG. 12 is a plan view of a still further alternative embodiment of a hinge assembly of the accordion shutter of FIG. 1 in an open position.
Figure 13:
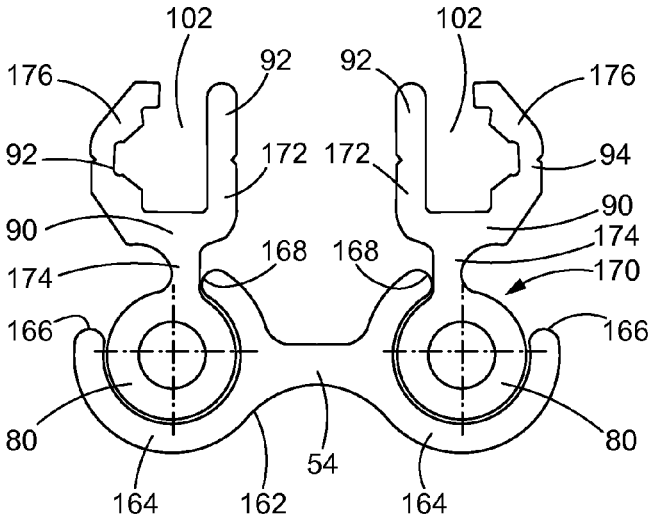
FIG. 13 is a plan view of the hinge assembly of FIG. 12 in a closed position.

FIGS. 12 and 13 illustrate another alternative embodiment of a hinge assembly 160 in accordance with the present disclosure, with the elements of the hinge assembly 160 that are similar to elements of the hinge assembly 14 as described above being identified with the same reference numerals. A hinge member 162 has a base 54 without a finger protection bar, and elongated penannular tube receiving portions 164 on either side of the base 54 having first tips 166 and second tips 168 creating gaps 170 there between. The penannular tube receiving portions 164 are similar to the curved arms 56 as described above and extend though arcs greater than 180° to retain the cylindrical tubes 80. However, the receiving portions 164 are rotated relative to the position of the curved arms 56 to open the gaps 170 outwardly from the base 54 in comparison to the gaps 64 between the tips 62 and the shoulders 66 of the panel connection member 52. Panel connection members 174 are generally similar to the panel connection members 52 with the curved connection portions 84 being replaced by generally planar connection members 176 extending through the corresponding gaps 170 when the cylindrical tubes 80 are disposed within the receiving portions 164. Panel connection portions 178 may be generally similar to the panel connection portions 82, but the ribs 96, 98 may be omitted depending on the configuration of the lateral edges 130 of the panels 12.

As shown in FIG. 12, the panel connection members 174 rotate to the open positions until the planar connection members 176 are engaged by the first tips 166 of the tube receiving portions 164. The panels 12 may rotate to an orientation that approaches 180° with respect to each other, and may be greater than 140°, but is less than 180° to prevent the panels 12 and hinge assembly 160 from inverting and creating difficulty in collapsing the accordion shutter 10. When the hinge assembly 160 collapses to the closed position shown in FIG. 13, the panel connection members 174 rotate toward each other until the planar connection portions 164 are engaged by the second tips 168 of the tube receiving portions 164 and the panels 12 are aligned parallel to each other. In this embodiment, pinch points on the exterior of the hinge assembly 160 are substantially eliminated due to the relatively small scale of the hinge assembly 160 in most installations of the accordion shutters 10. Pinch points on the interior of the hinge assembly 160 are also substantially eliminated for the same reason. However, the hinge assembly 160 has a spread design wherein the panel connection portions 174 are spaced from each other when the hinge assembly 160 is in the collapsed position shown in FIG. 13 to minimize the pinch risk on the interior of the hinge assembly 160.

INDUSTRIAL APPLICABILITY

The hinge assemblies 14, 120, 140, 160 in accordance with the present disclosure substantially eliminate pinch points at a minimum at the exteriors of the hinge assemblies 14, 120, 140, 160. In certain embodiments, at least the hinge assemblies 14, 120 partially or substantially eliminate pinch points at the interior of the hinge assemblies 14, 120. The components of the hinge assemblies 14, 120, 140, 160 are configured so that minimal space exist between the portions of the components moving past each other as the hinge assemblies 14, 120, 140, 160 move between their extended and collapsed positions. The minimal spaces prevent installers and other users of the accordion shutters 10 from inserting fingers between the relatively moving portions of the hinge assemblies 14, 120, 140, 160.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

What is claimed is:

1. A hinge assembly for connecting adjacent panels of a foldable closure along lateral edges of the adjacent panels, the hinge assembly comprising:

a hinge member having a pair of curved arms each having a tip and a substantially constant radius of curvature to sweep semi-circular arcs about a corresponding longitudinal axis of the curved arm; and a pair of panel connection members each having a pivot shaft, a panel connection portion configured to engage and retain a lateral edge of one of the adjacent panels, and a curved connection portion connecting the panel connection portion to the pivot shaft, wherein an inner surface of the curved connection portion and a portion of an outer surface of the pivot shaft of each panel connection member define an arm receiving channel having a closed end, wherein the pivot shaft of each of the pair of panel connection members is disposed within a corresponding one of the pair of curved arms of the hinge member and retained for rotation therein and with the tip of the curved arm received in the arm receiving channel of the panel connection member, and wherein the adjacent panels connected by the hinge assembly are rotatable between a closed position wherein the adjacent panels are approximately parallel to each other and an open position wherein the adjacent panels are oriented at an angle of less than 180° with respect to each other when both panel connection members are rotated to positions wherein the tips of the pair of curved arms are engaged by the closed ends of the arm receiving channels of the panel connection members.

2. The hinge assembly of claim 1, wherein the hinge member comprises a base, and wherein the pair of curved arms extends outwardly in opposite directions from the base.

3. The hinge assembly of claim 2, wherein the base of the hinge member comprises a pair of shoulders, with each shoulder being disposed proximate a point at which a corresponding one of the pair of curved arms extends from the base, and wherein the adjacent panels connected by the hinge assembly are in the closed position and are oriented approximately parallel with respect to each other when both of the pair of panel connection members are rotated to positions wherein the curved connection portions are engaged by the shoulders of the hinge member.

4. The hinge assembly of claim 2, wherein the hinge member comprises a finger protection bar extending from the base between the pair of curved arms and disposed between the curved connection portions of the panel connection members when the pivot shafts of the panel connection members are received by the pair of curved arms, and wherein the panel connection members rotate toward the finger protection bar when the adjacent panels are rotated from the open position to the closed position.

5. The hinge assembly of claim 4, wherein the base of the hinge member comprises a pair of shoulders, with each shoulder being disposed proximate a point at which a corresponding one of the pair of curved arms extends from the base, wherein the finger protection bar comprises an extension portion extending from the base of the hinge member and a cross member connected to the extension portion opposite the base and extending approximately perpendicular to the extension portion, wherein the cross member has opposite ends disposed proximate the curved connection portions of the corresponding panel connection members, and wherein the adjacent panels connected by the hinge assembly are oriented approximately parallel with respect to each other when both of the pair of panel connection members are rotated to positions wherein the curved connection portions are engaged by at least one of the shoulders of the base and the opposite ends of the finger protection bar.

6. The hinge assembly of claim 1, wherein the panel connection portion of each of the pair of panel connection members comprises:

an end wall having one end connected to the curved connection portion;

a first flange extending from the end wall proximate the curved connection portion; and a second flange extending from the end wall opposite the curved connection portion, wherein the first flange and the second flange define a panel receiving channel that is parallel to a plane of a panel inserted therein.

7. The hinge assembly of claim 1, wherein the pivot shafts of the panel connection members comprise hollow cylindrical tubes.

8. The hinge assembly of claim 1, wherein the pivot shafts of the panel connection members comprise penannular pivot shafts having openings opposite the curved connection portion such that the openings face inner surfaces of the pair of curved arms retaining the penannular pivot shafts for an entire range of rotation of the penannular pivot shafts within the pair of curved arms.

9. A foldable closure, comprising:

a pair of adjacent panels each having a lateral edge;

a hinge member having a pair of curved arms each having a tip and a substantially constant radius of curvature to sweep semi-circular arcs of greater than 180° about a corresponding longitudinal axis of the curved arm; and a pair of panel connection members each having a pivot shaft, a panel connection portion engaging and retaining the lateral edge of one of the pair of adjacent panels, and a curved connection portion connecting the panel connection portion to the pivot shaft, wherein an inner surface of the curved connection portion and a portion of an outer surface of the pivot shaft of each panel connection member define an arm receiving channel having a closed end, wherein the pivot shaft of each of the pair of panel connection members is disposed within a corresponding one of the pair of curved arms of the hinge member and retained for rotation therein, with the tip of the curved arm received in the arm receiving channel of the panel connection member, and wherein the pair of adjacent panels are rotatable between a closed position wherein the adjacent panels are approximately parallel to each other and an open position wherein the adjacent panels are oriented at an angle of less than 180° with respect to each other when both panel connection members are rotated to positions wherein the tips of the pair of curved arms are engaged by the closed ends of the arm receiving channels of the panel connection members.

10. The foldable closure of claim 9, wherein the hinge member comprises a base, and wherein the pair of curved arms extends outwardly in opposite directions from the base.

11. The foldable closure of claim 10, wherein the base of the hinge member comprises a pair of shoulders, with each shoulder being disposed proximate a point at which a corresponding one of the pair of curved arms extends from the base, and wherein the pair of adjacent panels are in the closed position and are oriented approximately parallel with respect to each other when both of the pair of panel connection members are rotated to positions wherein the curved connection portions are engaged by the shoulders of the hinge member.

12. The foldable closure of claim 10, wherein the hinge member comprises a finger protection bar extending from the base between the pair of curved arms and disposed between the curved connection portions of the panel connection members when the pivot shafts of the panel connection members are received by the pair of curved arms, and wherein the panel connection members rotate toward the finger protection bar when the adjacent panels are rotated from the open position to the closed position.

13. The foldable closure of claim 12, wherein the base of the hinge member comprises a pair of shoulders, with each shoulder being disposed proximate a point at which a corresponding one of the pair of curved arms extends from the base, wherein the finger protection bar comprises an extension portion extending from the base of the hinge member and a cross member connected to the extension portion opposite the base and extending approximately perpendicular to the extension portion, wherein the cross member has opposite ends disposed proximate the curved connection portions of the corresponding panel connection members, and wherein the pair of adjacent panels are oriented approximately parallel with respect to each other when both of the pair of panel connection members are rotated to positions wherein the curved connection portions are engaged by at least one of the shoulders of the base and the opposite ends of the finger protection bar.

14. The foldable closure of claim 9, wherein the panel connection portion of each of the pair of panel connection members comprises:

an end wall having one end connected to the curved connection portion;

a first flange extending from the end wall proximate the curved connection portion; and a second flange extending from the end wall opposite the curved connection portion, wherein the first flange and the second flange define a panel receiving channel that is parallel to a plane of the one of the pair of adjacent panels inserted therein.

15. The foldable closure of claim 9, wherein the pivot shafts of the panel connection members comprise hollow cylindrical tubes.

16. The foldable closure of claim 9, wherein the pivot shafts of the panel connection members comprise penannular pivot shafts having openings opposite the curved connection portion such that the openings face inner surfaces of the pair of curved arms retaining the penannular pivot shafts for an entire range of rotation of the penannular pivot shafts within the pair of curved arms.

17. A hinge assembly for connecting adjacent panels of a foldable closure along lateral edges of the adjacent panels, the hinge assembly comprising:

a hinge member comprising:

a base, a pair of curved arms extend outwardly in opposite directions from the base, with each curved arm having a tip and a substantially constant radius of curvature to sweep semi-circular arcs about a corresponding longitudinal axis of the curved arm, and a finger protection bar extending from the base between the pair of curved arms, wherein the tip of each of the pair of curved arms and the finger protection bar define a gap there between; and a pair of panel connection members, each panel connection member comprising:

a pivot shaft, a panel connection portion configured to engage and retain a lateral edge of one of the adjacent panels, and a curved connection portion connecting the panel connection portion to the pivot shaft, wherein an inner surface of the curved connection portion and a portion of an outer surface of the pivot shaft of each of the pair of panel connection members define an arm receiving channel having a closed end, wherein the pivot shaft of each of the pair of panel connection members is disposed within a corresponding one of the pair of curved arms of the hinge member and retained for rotation therein with the curved connection portion disposed within the gap defined by the finger protection bar and the tip of the curved arm retaining the pivot shaft, and with the tip of the curved arm received in the arm receiving channel of the panel connection member, and wherein the adjacent panels connected by the hinge assembly are rotatable between a closed position wherein the adjacent panels are approximately parallel to each other and an open position wherein the adjacent panels are oriented at an angle of less than 180° with respect to each other when both panel connection members are rotated to positions wherein the tips of the pair of curved arms are engaged by the closed ends of the arm receiving channels of the panel connection members, and wherein the panel connection members rotate toward the finger protection bar when the adjacent panels are rotated from the open position to the closed position.

18. The hinge assembly of claim 17, wherein the base of the hinge member comprises a pair of shoulders, with each shoulder being disposed proximate a point at which a corresponding one of the pair of curved arms extends from the base, and wherein the adjacent panels connected by the hinge assembly are oriented approximately parallel with respect to each other when both of the pair of panel connection members are rotated to positions wherein the curved connection portions are engaged by the shoulders of the hinge member.

19. The hinge assembly of claim 17, wherein the base of the hinge member comprises a pair of shoulders, with each shoulder being disposed proximate a point at which a corresponding one of the pair of curved arms extends from the base, and wherein the adjacent panels connected by the hinge assembly are oriented approximately parallel with respect to each other when both of the pair of panel connection members are rotated to positions wherein the curved connection portions are engaged by at least one of the shoulders of the base and the finger protection bar of the base.

20. The hinge assembly of claim 17, wherein the panel connection portion of each of the pair of panel connection members comprises:

an end wall having one end connected to the curved connection portion;

a first flange extending from the end wall proximate the curved connection portion; and a second flange extending from the end wall opposite the curved connection portion, wherein the first flange and the second flange define a panel receiving channel that is parallel to a plane of a panel inserted therein.

* * * * *